US008240398B2

(12) United States Patent
Lovorn et al.

(10) Patent No.: US 8,240,398 B2
(45) Date of Patent: Aug. 14, 2012

(54) ANNULUS PRESSURE SETPOINT CORRECTION USING REAL TIME PRESSURE WHILE DRILLING MEASUREMENTS

(75) Inventors: James R. Lovorn, Tomball, TX (US); Saad Saeed, Houston, TX (US); Nancy Davis, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/116,082

(22) Filed: May 26, 2011

(65) Prior Publication Data

US 2011/0303462 A1 Dec. 15, 2011

(30) Foreign Application Priority Data

Jun. 15, 2010 (WO) ..... PCT/US2010/038586

(51) Int. Cl.
*E21B 21/08* (2006.01)

(52) U.S. Cl. ..... 175/38; 175/48

(58) Field of Classification Search ..... 175/28, 175/38, 48, 24

See application file for complete search history.

(56) References Cited

U.S. PATENT DOCUMENTS

| | | | | |
|---|---|---|---|---|
| 6,648,081 | B2 | 11/2003 | Fincher et al. | |
| 6,823,950 | B2 | 11/2004 | Von Eberstein et al. | |
| 6,957,577 | B1 * | 10/2005 | Firmin | 73/152.51 |
| 7,044,237 | B2 | 5/2006 | Leuchtenberg | |
| 7,158,886 | B2 | 1/2007 | Hou et al. | |
| 2002/0108783 | A1 | 8/2002 | Elkins et al. | |
| 2004/0253734 | A1 * | 12/2004 | Firmin | 436/28 |
| 2007/0277975 | A1 | 12/2007 | Lovell et al. | |
| 2008/0210470 | A1 | 9/2008 | Stewart | |

FOREIGN PATENT DOCUMENTS

| | | | |
|---|---|---|---|
| WO | 03071091 | A1 | 8/2003 |
| WO | 2008051978 | A1 | 5/2008 |

OTHER PUBLICATIONS

Search Report issued Mar. 15, 2011 for International Application No. PCT/US10/38586, 5 pages.
Written Opinion issued Mar. 15, 2011 for International Application No. PCT/US10/38586, 3 pages.
Mike Reeves; "Intellipipe Moving Closer to Commercial Reality", Drilling Contractor article, dated Mar./Apr. 2004, 1 page.
Scott McMillan, et al.; "Overcoming Drilling Challenges in Northwest China Using an Innovative MPD Technique", SPE/IADC 130317, dated Feb. 24-25, 2010, 12 pages.
International Search Report with Written Opinion issued Mar. 15, 2011 for PCT Patent Application No. PCT/US10/038586, 8 pages.
Specification and drawings for Serial No. PCT/US11/59743, filed Nov. 8, 2011, 56 pages.

* cited by examiner

*Primary Examiner* — William P Neuder
(74) *Attorney, Agent, or Firm* — Smith IP Services, P.C.

(57) ABSTRACT

A method of controlling pressure in a wellbore can include determining a real time wellbore pressure $Pwb_{RT1}$ at a pressure sensor in the wellbore, calculating hydrostatic pressure $Ph_1$ at the pressure sensor, determining a real time annulus pressure $Pa_{RT}$, calculating friction pressure Pf due at least to circulation of the fluid through the wellbore and depth in the wellbore, calculating a friction pressure correction factor $CF_{Pf1}$ equal to $(Pwb_{RT1}-Ph_1-Pa_{RT})/Pf$, and controlling operation of a pressure control device, based on the friction pressure correction factor $CF_{Pf1}$. The method can further include determining a desired wellbore pressure $Pwb_{D1}$ at the pressure sensor, calculating an annulus pressure setpoint $Pa_{SP1}$ equal to $Pwb_{D1}-Ph_1-(Pf*CF_{Pf1})$, and adjusting the pressure control device as needed to maintain $Pa_{RT}$ equal to $Pa_{SP1}$.

30 Claims, 4 Drawing Sheets

ANNULUS PRESSURE SETPOINT CORRECTION USING REAL TIME PRESSURE WHILE DRILLING MEASUREMENTS

CROSS-REFERENCE TO RELATED APPLICATION

This application claims the benefit under 35 USC §119 of the filing date of International Application Serial No. PCT/US10/38586, filed 15 Jun. 2010. The entire disclosure of this prior application is incorporated herein by this reference.

BACKGROUND

The present disclosure relates generally to equipment utilized and operations performed in conjunction with a subterranean well and, in an embodiment described herein, more particularly provides for wellbore pressure control with an annulus pressure setpoint correction being made using real time pressure while drilling measurements.

In underbalanced and managed pressure drilling operations, it is beneficial to be able to maintain precise control over pressures exposed to drilled-through formations and zones. For example, in typical managed pressure drilling, a bottom hole pressure is maintained at a desired level by adjusting backpressure applied at or near the earth's surface while fluid is circulated through a drill string and wellbore.

Improvements are continually needed in the art of wellbore pressure control. Such improvements can enable more difficult drilling situations (such as narrow pore pressure/fracture pressure margins, etc.) to be successfully handled.

DETAILED DESCRIPTION

Figure 1:
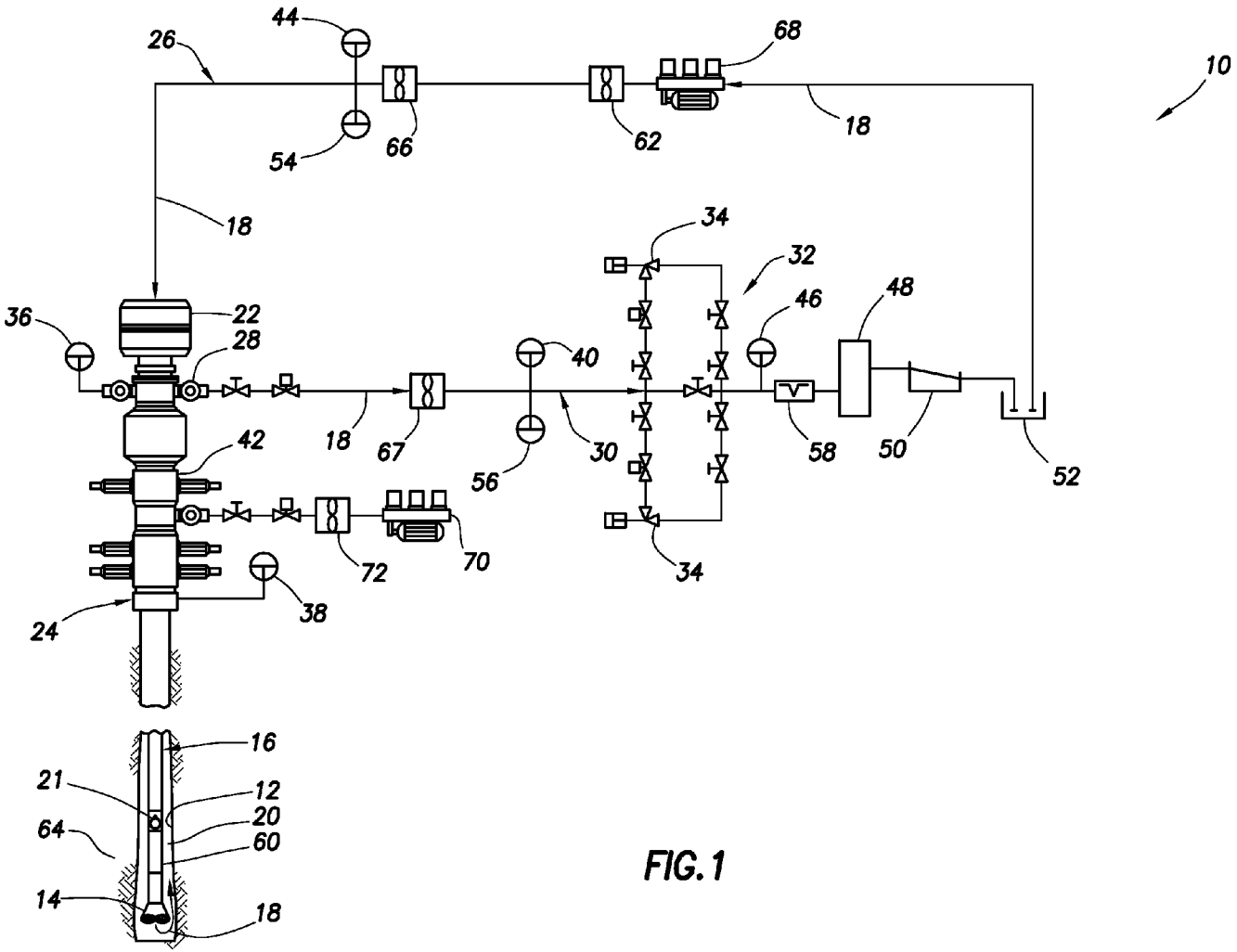
FIG. 1 is a schematic partially cross-sectional view of a well system and associated method which can embody principles of the present disclosure.

Representatively and schematically illustrated in FIG. 1 is a well system 10 and associated method which can embody principles of the present disclosure. In the system 10, a wellbore 12 is drilled by rotating a drill bit 14 on an end of a tubular drill string 16.

Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16 (for example, when connections are being made in the drill string).

Control of bottom hole pressure is very important in managed pressure and underbalanced drilling, and in other types of well operations. Preferably, the bottom hole pressure is accurately controlled to prevent excessive loss of fluid into an earth formation 64 surrounding the wellbore 12, undesired fracturing of the formation, undesired influx of formation fluids into the wellbore, etc.

In typical managed pressure drilling, it is desired to maintain the bottom hole pressure just greater than a pore pressure of the formation 64, without exceeding a fracture pressure of the formation. In typical underbalanced drilling, it is desired to maintain the bottom hole pressure somewhat less than the pore pressure, thereby obtaining a controlled influx of fluid from the formation 64.

Nitrogen or another gas, or another lighter weight fluid, may be added to the drilling fluid 18 for pressure control. This technique is especially useful, for example, in underbalanced drilling operations.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through fluid return line 30 to a choke manifold 32, which includes redundant chokes 34. Backpressure is applied to the annulus 20 by variably restricting flow of the fluid 18 through the operative choke(s) 34.

The greater the restriction to flow through the choke 34, the greater the backpressure applied to the annulus 20. Thus, bottom hole pressure can be conveniently regulated by varying the backpressure applied to the annulus 20. A hydraulics model can be used, as described more fully below, to determine a pressure applied to the annulus 20 at or near the surface which will result in a desired bottom hole pressure, so that an operator (or an automated control system) can readily determine how to regulate the pressure applied to the annulus at or near the surface (which can be conveniently measured) in order to obtain the desired bottom hole pressure.

It can also be desirable to control pressure at other locations along the wellbore 12. For example, the pressure at a casing shoe, at a heel of a lateral wellbore, in generally vertical or horizontal portions of the wellbore 12, or at any other location can be controlled using the principles of this disclosure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the fluid return line 30 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 66.

Not all of these sensors are necessary. For example, the system 10 could include only one of the flowmeters 62, 66. However, input from the sensors is useful to the hydraulics model in determining what the pressure applied to the annulus 20 should be during the drilling operation.

In addition, the drill string 16 may include its own sensors 60, for example, to directly measure bottom hole pressure. Such sensors 60 may be of the type known to those skilled in the art as pressure while drilling (PWD), measurement while drilling (MWD) and/or logging while drilling (LWD) sensor systems. These drill string sensor systems generally provide at least pressure measurement, and may also provide temperature measurement, detection of drill string characteristics (such as vibration, weight on bit, stick-slip, etc.), formation characteristics (such as resistivity, density, etc.) and/or other measurements. Various forms of telemetry (acoustic, pressure pulse, electromagnetic, optical, wired, etc.) may be used to transmit the downhole sensor measurements to the surface.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold (not shown) to the standpipe line 26, the fluid then circulates downward through the drill string 16, upward through the annulus 20, through the mud return line 30, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the bottom hole pressure, unless the fluid 18 is flowing through the choke. In conventional overbalanced drilling operations, a lack of circulation can occur whenever a connection is made in the drill string 16 (e.g., to add another length of drill pipe to the drill string as the wellbore 12 is drilled deeper), and the lack of circulation will require that bottom hole pressure be regulated solely by the density of the fluid 18.

In the system 10, however, flow of the fluid 18 through the choke 34 can be maintained, even though the fluid does not circulate through the drill string 16 and annulus 20. Thus, pressure can still be applied to the annulus 20 by restricting flow of the fluid 18 through the choke 34.

In the system 10 as depicted in FIG. 1, a backpressure pump 70 can be used to supply a flow of fluid to the return line 30 upstream of the choke manifold 32 by pumping fluid into the annulus 20 when needed (such as, when connections are being made in the drill string 16). Alternatively, or in addition, fluid could be diverted from the standpipe manifold to the return line 30 when needed, as described in International Application Serial No. PCT/US08/87686, and in U.S. application Ser. No. 12/638,012. Restriction by the choke 34 of such fluid flow from the rig pump 68 and/or the backpressure pump 70 will thereby cause pressure to be applied to the annulus 20.

The choke 34 and backpressure pump 70 are examples of pressure control devices which can be used to control pressure in the annulus 20 near the surface. Other types of pressure control devices (such as those described in International Application Serial No. PCT/US08/87686, and in U.S. application Ser. No. 12/638,012, etc.) may be used, if desired.

Figure 2:
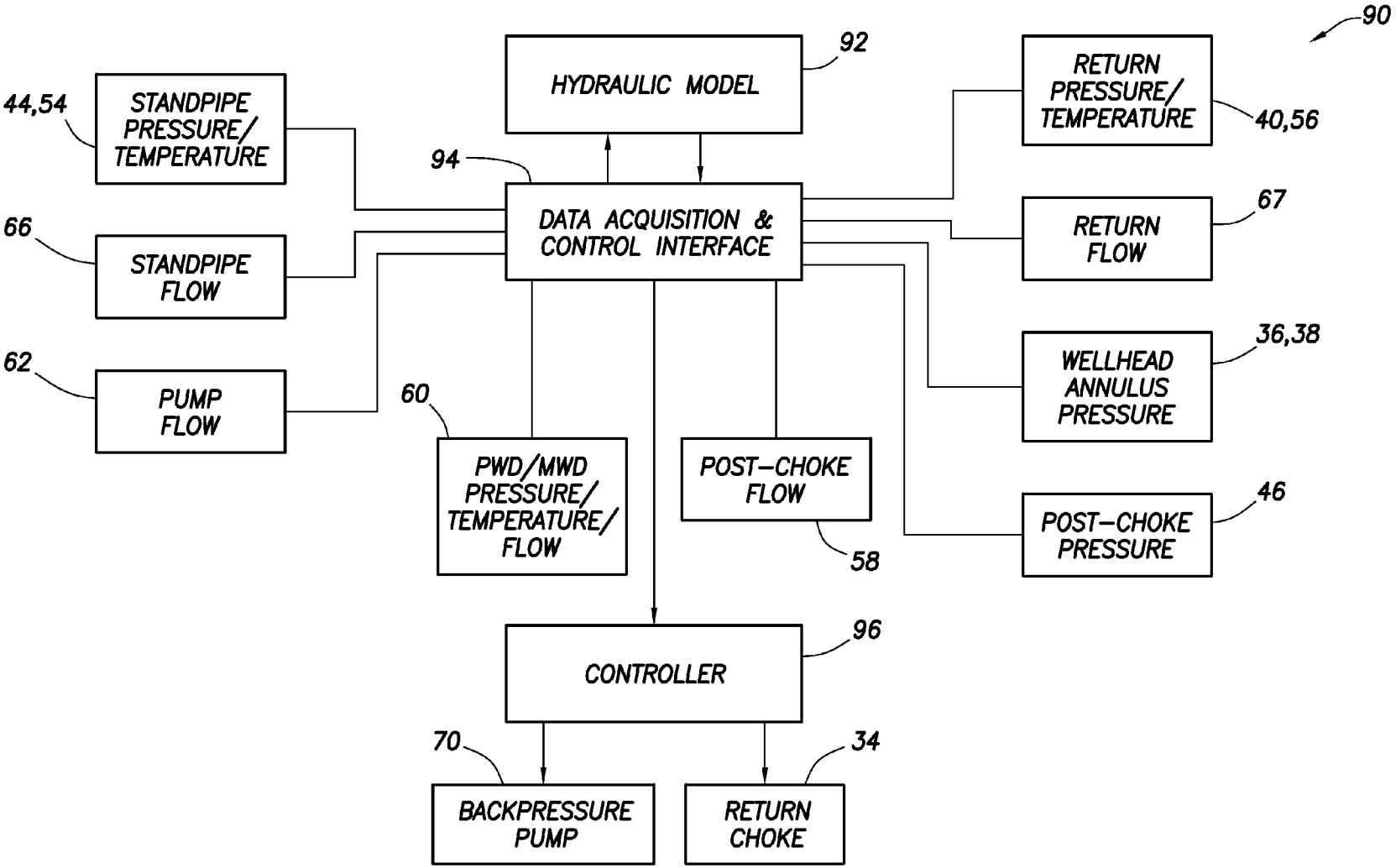
FIG. 2 is a block diagram of a pressure and flow control system which may be used with the well system and method of FIG. 1.

A pressure and flow control system 90 which may be used in conjunction with the system 10 and method of FIG. 1 is representatively illustrated in FIG. 2. The control system 90 is preferably fully automated, although some human intervention may be used, for example, to safeguard against improper operation, initiate certain routines, update parameters, etc.

The control system 90 includes a hydraulics model 92, a data acquisition and control interface 94 and a controller 96 (such as, a programmable logic controller or PLC, a suitably programmed computer, etc.). Although these elements 92, 94, 96 are depicted separately in FIG. 2, any or all of them could be combined into a single element, or the functions of the elements could be separated into additional elements, other additional elements and/or functions could be provided, etc.

The hydraulics model 92 is used in the control system 90 to determine the desired annulus pressure at or near the surface to achieve the desired bottom hole pressure, or pressure at another location in the wellbore. Data such as well geometry, fluid properties and offset well information (e.g., geothermal gradient and pore pressure gradient, etc.) are utilized by the hydraulics model 92 in making this determination, as well as real-time sensor data acquired by the data acquisition and control interface 94.

Thus, there is a continual two-way transfer of data and information between the hydraulics model 92 and the data acquisition and control interface 94. Preferably, the data acquisition and control interface 94 operates to maintain a substantially continuous flow of real-time data from the sensors 36, 38, 40, 44, 46, 54, 56, 58, 60, 62, 64, 66, 67 to the hydraulics model 92, so that the hydraulics model has the information it needs to adapt to changing circumstances and to update the desired annulus pressure. The hydraulics model 92 operates to supply the data acquisition and control interface 94 substantially continuously with a value for the desired annulus pressure.

A greater or lesser number of sensors may provide data to the interface 94, in keeping with the principles of this disclosure. For example, flow rate data from a flowmeter 72 which measures an output of the backpressure pump 70 may be input to the interface 94 for use in the hydraulics model 92.

A suitable hydraulics model for use as the hydraulics model 92 in the control system 90 is REAL TIME HYDRAULICS™ provided by Halliburton Energy Services, Inc. of Houston, Tex. USA. Another suitable hydraulics model is provided under the trade name IRIS™, and yet another is available from SINTEF of Trondheim, Norway. Any suitable hydraulics model may be used in the control system 90 in keeping with the principles of this disclosure.

A suitable data acquisition and control interface for use as the data acquisition and control interface 94 in the control system 90 are SENTRY™ and INSITE™ provided by Halliburton Energy Services, Inc. Any suitable data acquisition and control interface may be used in the control system 90 in keeping with the principles of this disclosure.

The controller 96 operates to maintain a desired setpoint annulus pressure by controlling operation of the fluid return choke 34, the backpressure pump 70 and/or another pressure control device. When an updated desired annulus pressure is transmitted from the data acquisition and control interface 94 to the controller 96, the controller uses the desired annulus pressure as a setpoint and controls operation of the choke 34 and/or backpressure pump 70 in a manner (e.g., increasing or decreasing flow through the choke as needed) to maintain the setpoint pressure in the annulus 20.

This is accomplished by comparing the setpoint pressure to a measured annulus pressure (such as the pressure sensed by any of the sensors 36, 38, 40), and increasing flow through the choke 34 if the measured pressure is greater than the setpoint pressure, and decreasing flow through the choke if the measured pressure is less than the setpoint pressure. Of course, if the setpoint and measured pressures are the same, then no adjustments of the choke 34 and/or backpressure pump 70 are required. This process is preferably automated, so that no human intervention is necessary, although human intervention may be used if desired.

The controller 96 may also be used to control operation of the backpressure pump 70. More flow can be supplied from the backpressure pump 70 if the measured pressure is less than the setpoint pressure, and less flow can be supplied from the backpressure pump if the measured pressure is greater than the setpoint pressure.

The controller 96 can, thus, be used to automate the process of supplying fluid flow to the return line 30 when needed. Again, no human intervention may be required for this process.

Figure 3:
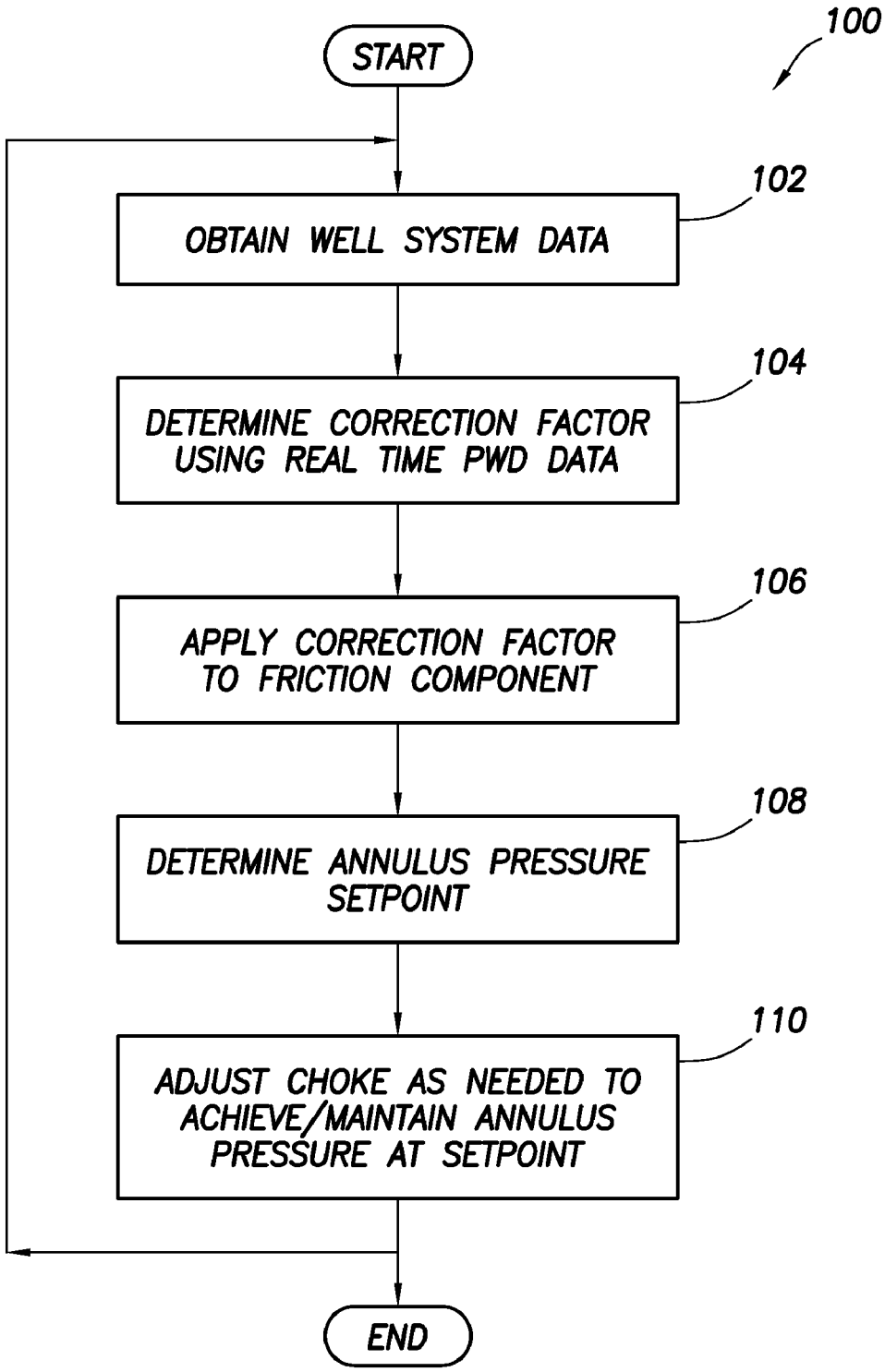
FIG. 3 is a flowchart for a method which embodies principles of the present disclosure.

Referring additionally now to FIG. 3, a schematic flowchart for a method 100 of controlling pressure in the wellbore 12 is representatively illustrated. The method 100 may be used with the well system 10, or with other well systems. In the method 100, a correction factor is applied to a friction pressure determined by the hydraulics model 92, and is used to adjust the choke 34 as needed to maintain an annulus pressure setpoint.

As discussed above, the hydraulics model 92 is used in the control system 90 to determine the desired annulus pressure at or near the surface to achieve the desired bottom hole pressure, or a desired pressure at another location in the wellbore. The hydraulics model 92 supplies the data acquisition and control interface 94 substantially continuously with a value for the desired annulus pressure (the annulus pressure setpoint).

One variable calculated by the hydraulics model 92 is friction pressure, which is due to circulation of the fluid 18 through the wellbore 12. Friction pressure is a backpressure due to resistance to flow of the fluid 18 through the wellbore 12 (influenced by various factors, such as, rheological properties of the fluid itself, wellbore geometry, wellbore depth, surface roughness, etc.), swab and surge during displacement of the drill string 16 in the wellbore, etc.

In a prior hydraulics model, the annulus pressure setpoint would be calculated as equal to the desired bottom hole pressure minus the bottom hole hydrostatic pressure minus a calculated friction pressure. The hydraulics model would use the data supplied to it to calculate the friction pressure, but no matter how accurate the data, there will always be real world variables unaccounted for in the data.

To solve this problem, the method 100 uses pressure measurements obtained from one or more downhole pressure sensors (such as PWD sensors, pressure sensors in the drill pipe, etc.) to determine a correction factor to be applied to the calculated friction pressure. In this manner, real time pressure measurements are used to generate the correction factor, which accounts for the various real world variables which would not otherwise be considered in the friction pressure calculation.

In step 102, the data related to the well system 10 is obtained. This data may be supplied to the hydraulics model 92 via the data acquisition & control interface 94 as described above, or may be input directly to the hydraulics model, etc.

Preferably, for variables which change over time during the drilling operation, the data is supplied to the hydraulics model 92 in real time. For data which changes relatively slowly (such as wellbore geometry), "real time" may be within one or more hours. For data which can change relatively rapidly (such as pressure, flow and choke position data), "real time" is preferably within one minute, although in some circumstances a few minutes may be appropriate.

Pressure measurements can be relatively erratic, and pressure measurements from downhole sensors can be sporadically received, and so it is preferred that techniques such as filtering, averaging, spike elimination, threshold values, standard deviation, etc., are applied to the real time pressure measurements. In this manner, the real time pressure measurements are validated to ensure that only reasonable data is used in the subsequent calculations. These techniques may be used for other types of data, as well.

In step 104, a friction pressure correction factor is determined using the real time pressure measurement data. A preferred equation for calculating the correction factor is:

$$CF_{Pf}=(Pwb_{RT}-Ph-Pa_{RT})/Pf \quad (1)$$

in which $CF_{Pf}$ is the friction pressure correction factor, $Pwb_{RT}$ is the real time wellbore pressure as measured by the downhole pressure sensor, Ph is the calculated hydrostatic pressure at that downhole pressure sensor (mud density*true vertical depth to the pressure sensor), $Pa_{RT}$ is the real time annulus pressure measured at or near the surface, and Pf is the friction pressure as calculated by the hydraulics model 92. The friction pressure Pf is due to circulation of the fluid 18 through the wellbore 12 and depends on factors such as depth of the drill string 16 in the wellbore during such circulation, etc. Friction pressure can also be due to displacement of the drill string 16 through the wellbore 12 (e.g., effects known to those skilled in the art as swab and surge).

In step 106, the correction factor $CF_{Pf}$ is applied to the calculated friction pressure Pf, yielding a corrected friction pressure ($Pf*CF_{Pf}$) which accounts for various real world variables not otherwise accounted for in the hydraulics model 92. Calculation of the correction factor, and application of the correction factor to the calculated friction pressure is preferably performed automatically and at regular, short intervals.

In step 108, the annulus pressure setpoint is determined, using the corrected friction pressure. A preferred equation for calculating the annulus pressure setpoint is:

$$Pa_{SP}=Pwb_{D}-Ph-(Pf*CF_{Pf}) \quad (2)$$

in which $Pa_{SP}$ is the annulus pressure setpoint, $Pwb_{D}$ is a desired wellbore pressure, Ph is the calculated hydrostatic pressure, Pf is the calculated friction pressure, and $CF_{Pf}$ is the friction pressure correction factor.

The annulus pressure setpoint is supplied by the hydraulics model 92 to the data acquisition and control interface 94 for use by the controller 96 to control operation of the choke 34. Preferably, the annulus pressure setpoint is updated continuously and automatically, so that the choke 34 can be continuously and automatically controlled, based on the latest available data.

In step 110, the choke 34 and/or backpressure pump 70 is adjusted as needed to maintain the annulus pressure at the setpoint determined in step 108. As described above, the choke 34 would be opened more if the annulus pressure exceeds the setpoint, and the choke would be closed more if the annulus pressure is below the setpoint. More flow can be supplied by the backpressure pump 70 if the annulus pressure is below the setpoint, and less flow can be supplied by the backpressure pump if the annulus pressure exceeds the setpoint.

Steps 102-110 are preferably performed continuously during a drilling operation, such as, at any time fluid 18 is circulated through the drill string 16, or even when fluid is not circulated through the drill string. Although the steps 104-110 are depicted in FIG. 3 as being performed following one or more other steps, some of these steps can be performed in parallel with other steps, and do not necessarily depend on the other steps being performed.

For example, step 110 can be performed continuously and automatically in the well system 10, even if updated annulus pressure setpoints are not supplied according to the method 100 as described above. In one scenario, the controller 96 can continue to control operation of the choke 34, based on a last determined annulus pressure setpoint, or a manually input annulus pressure setpoint, even if the hydraulics model 92 were to become inoperative.

An automated drilling event detection system is described in International Application No. PCT/US09/52227, filed 30 Jul. 2009. In that system, values are assigned to behaviors of various drilling parameters, and parameter signatures are formed by combinations of the values. If the parameter signatures partially or completely match a signature of a drilling event, then a drilling operation can be controlled based on the match.

The correction factor determined in the method 100 as described above can be included as one of the drilling parameters in the drilling event detection system described in the international application referred to above. Clearly, a change in the correction factor (which would be indicative of a change in real world conditions not accounted for by the hydraulic model 92) could be indicative of a certain drilling event.

Figure 4:
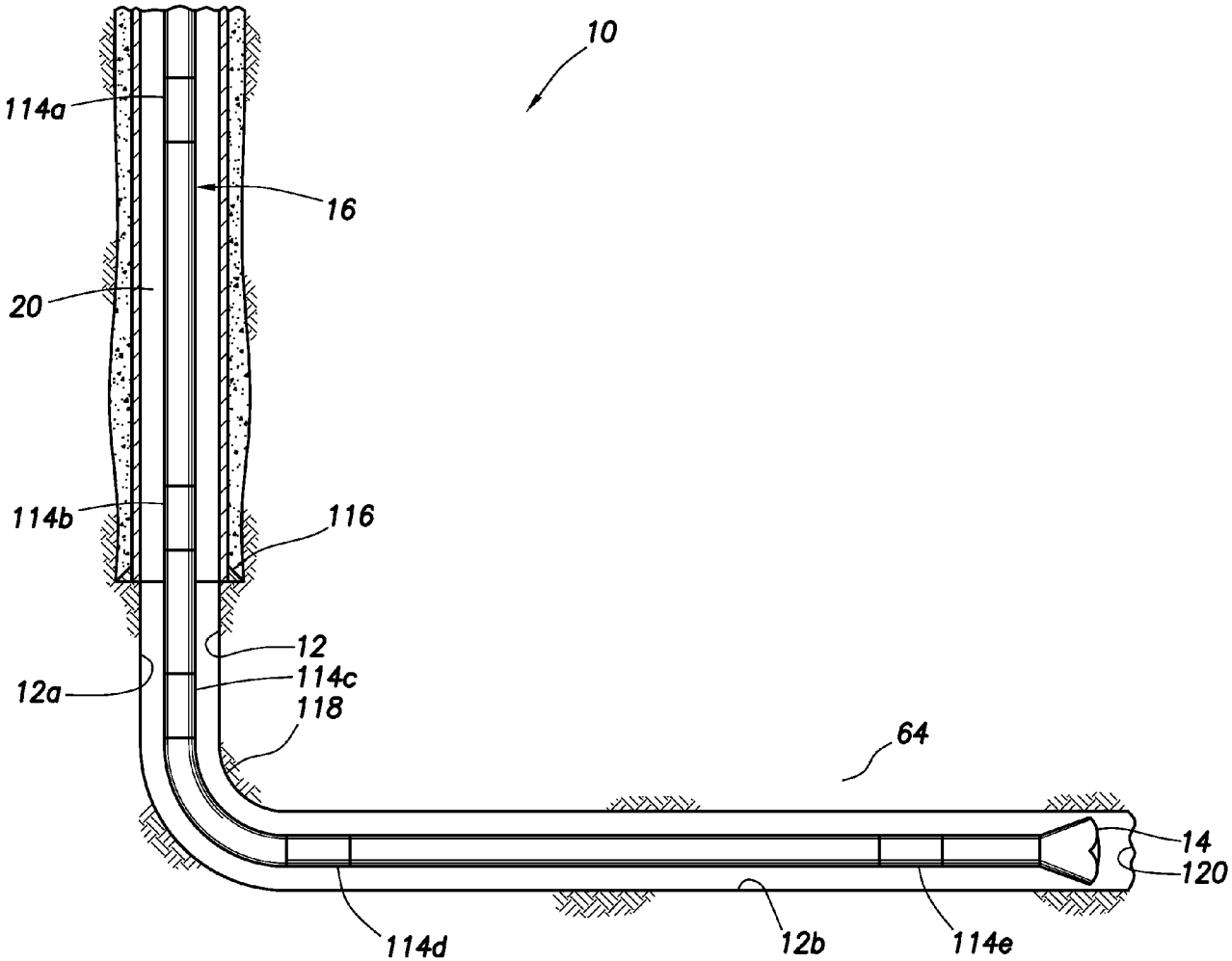
FIG. 4 is a schematic cross-sectional view of the well system in which multiple pressure while drilling (PWD) sensors are interconnected at spaced apart locations along a drill string.

Referring additionally now to FIG. 4, another configuration of the downhole portion of the well system 10 is representatively illustrated. In this configuration, the wellbore 12 includes both a generally vertical section 12*a* and a generally horizontal section 12*b*. In addition, the drill string 16 includes multiple spaced apart pressure sensors 114*a-e*.

The pressure sensors 114*a-e* may be of the type known as pressure while drilling (PWD) sensors, which are interconnected as part of the drill string 16. Typically, indications of pressure sensed by PWD sensors are transmitted via mud pulse telemetry, while the fluid 18 is being circulated through the drill string 16, but other forms of telemetry may be used, if desired.

Alternatively, the pressure sensors 114*a-e* could be other types of sensors, such as sensors incorporated into the drill string 16 itself (e.g., using IntelliPipe™ wired drill pipe marketed by IntelliServ, Inc.). Indications of downhole pressure measured by such sensors can be transmitted continuously, and whether or not the fluid 18 is being circulated through the drill string 16.

Preferably, the pressure sensors 114*a-e* are positioned at locations proximate areas of the wellbore 12 at which it would be desired to control the pressure using the method 100 described above. For example, as depicted in FIG. 4, the sensor 114*a* is positioned in the generally vertical section 12*a* of the wellbore 12, the sensor 114*b* is positioned proximate a casing shoe 116 at a lowermost cased or lined section of the wellbore, the sensor 114*c* is positioned proximate a transition 118 between the generally vertical and generally horizontal sections of the wellbore (known to those skilled in the art as a "heel" of a lateral wellbore), the sensor 114*d* is positioned in the generally horizontal section of the wellbore, and the sensor 114*e* is positioned proximate the drill bit 14 and a bottom 120 of the wellbore.

Sensors have been developed which can determine the pressure in the formation ahead of the drill bit 14 (i.e., in a portion of the formation which has not yet been drilled into, but which is in the path of the drill bit). Thus, using the principles of this disclosure, the pressure in the formation ahead of the drill bit 14 can be used for controlling the pressure in the wellbore 12.

Of course, the positions of the pressure sensors 114*a-e* will change over time as the wellbore 12 is drilled further. However, the pressure sensor 114*e* can remain proximate the drill bit 14, and can remain proximate the bottom 120 of the wellbore, at least during drilling or otherwise while the drill bit remains near the bottom of the wellbore. Furthermore, the other pressure sensors 114*a-d* can be appropriately spaced apart by advanced planning, so that at least one of them will be near a location at which it may be desired to accurately control the wellbore pressure.

Using instrumented drill pipe (such as the IntelliPipe™ mentioned above), any number of sensors can be distributed along the drill string 16, and at any positions. Thus, the principles of this disclosure are not limited at all to any specific numbers or positions of sensors in the wellbore 12.

Note that it is not necessary in keeping with the principles of this disclosure for wellbore pressure to be controlled only at the bottom 120 of the wellbore 12. Instead, wellbore pressure can be accurately controlled at any location in the wellbore 12.

For example, it may be desired to control wellbore pressure at the casing shoe 116 to prevent breaking down the casing shoe. Alternatively, or in addition, it may be desired to control wellbore pressure at the heel transition 118.

If multiple PWD pressure sensors 114*a-e* are used, a multi-frequency pressure pulse telemetry system is available from Sperry Drilling Services of Houston, Tex. USA for simultaneously transmitting pressure measurements to the surface. Of course, other types of pressure sensors and other types of telemetry may be used in keeping with the principles of this disclosure.

If, for example, it is desired to control wellbore pressure at the heel transition 118, the pressure measurements received from the pressure sensor 114*c* or 114*d* and the hydrostatic pressure at the pressure sensor can be used in step 104 to calculate the correction factor to be applied to the calculated friction pressure. Then, in step 108 an annulus pressure setpoint can be determined which will result in a desired wellbore pressure at the pressure sensor 114*c* or 114*d* (and, thus, at the heel transition 118 by compensating for any difference in hydrostatic and friction pressure) being obtained when the choke 34 is adjusted to maintain the annulus pressure setpoint in step 110.

Thus, it will be appreciated that a desired wellbore pressure can be obtained at any location along the wellbore 12 using the principles of this disclosure. The location is not necessarily at a position of one of the pressure sensors 114*a-e*, since differences in hydrostatic and friction pressure can be readily calculated using the hydraulics model 92, or wired drill pipe can be used to distribute pressure sensors at many locations (or even continuously) along the wellbore 12.

It can now be fully understood that several advancements are provided to the well pressure control art by the above disclosure. By use of the method 100, friction pressure as calculated by the hydraulics model 92 can be corrected based on pressure measurements received from a downhole pressure sensor 114*a-e*. In addition, a desired pressure can be obtained at any location along the wellbore 12 using the method 100.

The above disclosure provides to the art a method 100 of controlling pressure in a wellbore 12. The method 100 includes determining a real time wellbore pressure $Pwb_{RT1}$ at a first pressure sensor (any of pressure sensors 60 or 114*a-e*) in the wellbore 12; calculating hydrostatic pressure $Ph_1$ at the first pressure sensor in the wellbore 12; determining a real time annulus pressure $Pa_{RT}$; calculating friction pressure Pf due to circulation of the fluid 18 through the drill string 16 and depth of the drill string 16 in the wellbore 12; calculating a friction pressure correction factor $CF_{Pf1}$ equal to $(Pwb_{RT1}-Ph_1-Pa_{RT})/Pf$; and controlling operation of a pressure control device 34, 70, based on the friction pressure correction factor $CF_{Pf1}$.

The step of determining a real time wellbore pressure $Pwb_{RT1}$ at a first pressure sensor can be performed while circulating fluid 18 through the drill string 16 and/or while the fluid is not circulating through the drill string.

The first pressure sensor 114*e* may be located proximate a bottom 120 of the wellbore 12 while determining the real time wellbore pressure $Pwb_{RT1}$.

The first pressure sensor 114*d* or 114*e* may be located in a generally horizontal section 12*b* of the wellbore 12 while determining the real time wellbore pressure $Pwb_{RT1}$.

The first pressure sensor 114*b* may be located proximate a casing shoe 116 in the wellbore 12 while determining the real time wellbore pressure $Pwb_{RT1}$.

The first pressure sensor 114*a* or 114*b* or 114*c* may be located in a generally vertical section 12*a* of the wellbore 12 while determining the real time wellbore pressure $Pwb_{RT1}$.

The first pressure sensor 114*c* or 114*d* may be located proximate a transition 118 between generally vertical and generally horizontal sections 12*a,b* of the wellbore 12 while determining the real time wellbore pressure $Pwb_{RT1}$.

The method 100 can also include calculating a desired wellbore pressure $Pwb_{D1}$ at the first pressure sensor; and calculating an annulus pressure setpoint $Pa_{SP}$ equal to $Pwb_{D1}-Ph_1-(Pf*CF_{Pf1})$. Controlling operation of the pressure control device 34, 70 preferably includes adjusting the pressure control device as needed to maintain $Pa_{RT}$ equal to $Pa_{SP}$.

The first pressure sensor may be positioned at a remote location which is remote from a bottom 120 of the wellbore 12, and controlling operation of the pressure control device 34, 70 may further include maintaining the desired wellbore pressure $Pwb_{D1}$ at the remote location of the first pressure sensor.

The remote location may be proximate a casing shoe 116 in the wellbore 12, or proximate a transition 118 between generally vertical and generally horizontal sections 12*a,b* of the wellbore 12.

A second pressure sensor 114*e* may be positioned in the wellbore 12 proximate a drill bit 14 on the drill string 16. The first pressure sensor 114*a-d* can be located remote from the second pressure sensor 114*e*.

The method 100 may include determining a real time wellbore pressure $Pwb_{RT2}$ at the second pressure sensor 114*e* in the wellbore 12; calculating hydrostatic pressure $Ph_2$ at the second pressure sensor 114*e* in the wellbore 12; calculating a friction pressure correction factor $CF_{Pf2}$ equal to $(Pwb_{RT2}-Ph_2-Pa_{RT})/Pf$; and controlling operation of the pressure control device 34, 70, based on the friction pressure correction factor $CF_{Pf2}$.

The step of determining a real time wellbore pressure $Pwb_{RT2}$ at the second pressure sensor 114*e* may be performed while the fluid 18 is circulated through the drill string 16 and/or while the fluid is not circulated through the drill string.

The method 100 may further include calculating a desired wellbore pressure $Pwb_{D2}$ at the second pressure sensor 114*e*; and calculating an annulus pressure setpoint $Pa_{SP}$ equal to $Pwb_{D2}-Ph_2-(Pf*CF_{Pf2})$. Controlling operation of the pressure control device 34, 70 can include adjusting the pressure control device 34, 70 as needed to maintain $Pa_{RT}$ equal to $Pa_{SP}$.

The pressure control device may comprise a fluid return choke 34 which variably restricts flow of the fluid 18 from the wellbore 12. The pressure control device may comprise a backpressure pump 70 which supplies a flow of the fluid 18 to a return line 30 upstream of a choke manifold 32.

The above disclosure also describes the method 100 of controlling pressure in a wellbore 12, with the method including determining a real time wellbore pressure $Pwb_{RT1}$ at a first pressure sensor (such as any of sensors 60 or 114*a-e*) in the wellbore 12; calculating hydrostatic pressure $Ph_1$ at the first pressure sensor in the wellbore 12; determining a real time annulus pressure $Pa_{RT}$; calculating friction pressure Pf due to circulation of the fluid 18 through the wellbore 12 and depth in the wellbore 12; calculating a friction pressure correction factor $CF_{Pf1}$ equal to $(Pwb_{RT1}-Ph_1-Pa_{RT})/Pf$; calculating a desired wellbore pressure $Pwb_{D1}$ at the first pressure sensor; calculating an annulus pressure setpoint $Pa_{SP1}$ equal to $Pwb_{D1}-Ph_1-(Pf*CF_{Pf1})$; and controlling operation of a pressure control device 34, 70, by adjusting the pressure control device as needed to maintain $Pa_{RT}$ equal to $Pa_{SP1}$.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of controlling pressure in a wellbore, the method comprising:

determining a real time wellbore pressure $Pwb_{RT1}$ at a first pressure sensor in the wellbore;

calculating hydrostatic pressure $Ph_1$ at the first pressure sensor in the wellbore;

determining a real time annulus pressure $Pa_{RT}$;

calculating friction pressure Pf due at least to circulation of a fluid through the wellbore and a depth of a drill string in the wellbore;

calculating a friction pressure correction factor $CF_{Pf1}$ equal to $(Pwb_{RT1-Ph1}-Pa_{RT})/Pf$; and controlling operation of a pressure control device based at least in part on the friction pressure correction factor $CF_{Pf1}$.

2. The method of claim 1, wherein the first pressure sensor is located proximate a bottom of the wellbore while determining the real time wellbore pressure $Pwb_{RT1}$.

3. The method of claim 1, wherein the first pressure sensor is located in a generally horizontal section of the wellbore while determining the real time wellbore pressure $Pwb_{RT1}$.

4. The method of claim 1, wherein the first pressure sensor is located proximate a casing shoe in the wellbore while determining the real time wellbore pressure $Pwb_{RT1}$.

5. The method of claim 1, wherein the first pressure sensor is located in a generally vertical section of the wellbore while determining the real time wellbore pressure $Pwb_{RT1}$.

6. The method of claim 1, wherein the first pressure sensor is located proximate a transition between generally vertical and generally horizontal sections of the wellbore while determining the real time wellbore pressure $Pwb_{RT1}$.

7. The method of claim 1, further comprising:

calculating a desired wellbore pressure $Pwb_{D1}$ at the first pressure sensor; and calculating an annulus pressure setpoint $Pa_{SP}$ equal to $Pwb_{D1}-Ph_1-(Pf*CF_{Pf1})$.

8. The method of claim 7, wherein controlling operation of the pressure control device further comprises adjusting the pressure control device as needed to maintain $Pa_{RT}$ equal to $Pa_{SP}$.

9. The method of claim 8, wherein the first pressure sensor positioned at a remote location which is remote from a bottom of the wellbore, and wherein controlling operation of the pressure control device further comprises maintaining the desired wellbore pressure $Pwb_{D1}$ at the remote location of the first pressure sensor.

10. The method of claim 9, wherein the remote location is proximate a casing shoe in the wellbore.

11. The method of claim 9, wherein the remote location is proximate a transition between generally vertical and generally horizontal portions of the wellbore.

12. The method of claim 1, further comprising a second pressure sensor in the wellbore proximate a drill bit on the drill string, and wherein the first pressure sensor is located remote from the second pressure sensor.

13. The method of claim 12, further comprising:

determining a real time wellbore pressure $Pwb_{RT2}$ at the second pressure sensor in the wellbore;

calculating hydrostatic pressure $Ph_2$ at the second pressure sensor in the wellbore;

calculating a friction pressure correction factor $CF_{Pf2}$ equal to $(Pwb_{RT2}-Ph_2-Pa_{RT})/Pf$; and controlling operation of the pressure control device, based on the friction pressure correction factor $CF_{Pf2}$.

14. The method of claim 13, further comprising:

calculating a desired wellbore pressure $Pwb_{D2}$ at the second pressure sensor; and calculating an annulus pressure setpoint $Pa_{SP}$ equal to $Pwb_{D2}-Ph_2-(Pf*CF_{Pf2})$.

15. The method of claim 14, wherein controlling operation of the pressure control device further comprises adjusting the pressure control device as needed to maintain $Pa_{RT}$ equal to $Pa_{SP}$.

16. The method of claim 1, wherein the pressure control device comprises a fluid return choke which variably restricts flow of the fluid from the wellbore.

17. The method of claim 1, wherein the pressure control device comprises a backpressure pump which supplies a flow of the fluid to a return line upstream of a choke manifold.

18. A method of controlling pressure in a wellbore, the method comprising:

determining a real time wellbore pressure $Pwb_{RT1}$ at a first pressure sensor in the wellbore;

calculating hydrostatic pressure $Ph_1$ at the first pressure sensor in the wellbore;

determining a real time annulus pressure $Pa_{RT}$;

calculating friction pressure Pf due at least to circulation of a fluid through the wellbore and a depth in the wellbore;

calculating a friction pressure correction factor $CF_{Pf1}$ equal to $(Pwb_{RT}-Ph_1-Pa_{RT})/Pf$;

calculating a desired wellbore pressure $Pwb_{D1}$ at the first pressure sensor;

calculating an annulus pressure setpoint $Pa_{SP1}$ equal to $Pwb_{D1}-Ph_1-(Pf*CF_{Pf1})$; and controlling operation of a pressure control device as needed to maintain $Pa_{RT}$ equal to $Pa_{SP1}$.

19. The method of claim 18, wherein the first pressure sensor is located proximate a bottom of the wellbore while determining the real time wellbore pressure $Pwb_{RT1}$.

20. The method of claim 18, wherein the first pressure sensor is located in a generally horizontal section of the wellbore while determining the real time wellbore pressure $Pwb_{RT1}$.

21. The method of claim 18, wherein the first pressure sensor is located proximate a casing shoe in the wellbore while determining the real time wellbore pressure $Pwb_1$.

22. The method of claim 18, wherein the first pressure sensor is located in a generally vertical section of the wellbore while determining the real time wellbore pressure $Pwb_{RT1}$.

23. The method of claim 18, wherein the first pressure sensor is located proximate a transition between generally vertical and generally horizontal sections of the wellbore while determining the real time wellbore pressure $Pwb_{RT1}$.

24. The method of claim 18, wherein the first pressure sensor is positioned at a location which is remote from a bottom of the wellbore, and wherein controlling operation of the pressure control device further comprises maintaining the desired wellbore pressure $Pwb_{D1}$ at the remote location of the first pressure sensor.

25. The method of claim 24, wherein the remote location is proximate a casing shoe in the wellbore.

26. The method of claim 24, wherein the remote location is proximate a transition between generally vertical and generally horizontal portions of the wellbore.

27. The method of claim 18, further comprising a second pressure sensor in the wellbore proximate a drill bit on the drill string, and wherein the first pressure sensor is located remote from the second pressure sensor.

28. The method of claim 27, further comprising:

determining a real time wellbore pressure $Pwb_{RT2}$ at the second pressure sensor in the wellbore;

calculating hydrostatic pressure $Ph_2$ at the second pressure sensor in the wellbore;

calculating a friction pressure correction factor $CF_{Pf2}$ equal to $(Pwb_{RT2}-Ph_2-Pa_{RT})/Pf$;

calculating a desired wellbore pressure at the second pressure sensor $Pwb_{D2}$;

calculating an annulus pressure setpoint $Pa_{SP2}$ equal to $Pwb_{D2}-Ph_2-(Pf*CF_{Pf2})$; and adjusting the pressure control device as needed to maintain $Pa_{RT}$ equal to $Pa_{SP2}$.

29. The method of claim 18, wherein the pressure control device comprises a fluid return choke which variably restricts flow of the fluid from the wellbore.

30. The method of claim 18, wherein the pressure control device comprises a backpressure pump which supplies a flow of the fluid to a return line upstream of a choke manifold.

* * * * *

UNITED STATES PATENT AND TRADEMARK OFFICE

CERTIFICATE OF CORRECTION

PATENT NO. : 8,240,398 B2
APPLICATION NO. : 13/116082
DATED : August 14, 2012
INVENTOR(S) : James R. Lovorn, Saad Saeed and Nancy Davis It is certified that error appears in the above-identified patent and that said Letters Patent is hereby corrected as shown below:

Col. 10,
Claim 1, line 61, cancel " $\{Pwb_{RT1_Ph1} - Pa_{RT}\}/Pf$ " and insert in place thereof -- $\{Pwb_{RT1} - Ph_1 - Pa_{RT}\} / Pf$ --.

Col. 12,
Claim 18, line 7, cancel " $\{Pwb_{RT} - Ph_1 - Pa_{RT}\}/Pf$ " and insert in place thereof -- $\{Pwb_{RT1} - Ph_1 - Pa_{RT}\} / Pf$ --.

Col. 12,
Claim 21, line 22, cancel " $Pwb_1$ " and insert in place thereof -- $Pwb_{RT1}$ --.

Signed and Sealed this
Twenty-third Day of October, 2012

David J. Kappos

David J. Kappos
*Director of the United States Patent and Trademark Office*